US006029675A

United States Patent [19]

Dumler

[11] Patent Number: 6,029,675

[45] **Date of Patent: *Feb. 29, 2000**

[54] MASCARA BRUSH UNIT

[75] Inventor: Norbert Dumler, Ansbach, Germany

[73] Assignee: georg karl geka-brush gmbh, Bechhofen-Waizendorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/637,742

[22] PCT Filed: Oct. 28, 1994

[86] PCT No.: PCT/EP94/03558

§ 371 Date: Jul. 30, 1996

§ 102(e) Date: Jul. 30, 1996

[87] PCT Pub. No.: WO95/12332

PCT Pub. Date: May 11, 1995

[30] Foreign Application Priority Data

Nov. 2, 1993 [DE] Germany ..... 93 16 704 U

[51] Int. Cl.[7] ..... A45D 40/26

[52] U.S. Cl. ..... 132/218; 401/10; 401/129

[58] Field of Search ..... 401/10, 37, 38, 401/39, 129, 126, 287, 284; 132/218, 217, 216, 221, 317, 313, 112, 116

[56] References Cited

U.S. PATENT DOCUMENTS

| | | | |
|---|---|---|---|
| 2,895,486 | 7/1959 | Sayer . | |
| 4,733,425 | 3/1988 | Hartel et al. | 132/218 |
| 4,875,602 | 10/1989 | Chickering et al. | 401/284 |
| 5,007,442 | 4/1991 | Hirzel . | |
| 5,052,839 | 10/1991 | Pettengill | 401/10 |
| 5,222,268 | 6/1993 | Snodgrass | 401/10 |
| 5,307,826 | 5/1994 | Iosilevich | 132/218 |
| 5,339,841 | 8/1994 | Gueret | 132/218 |

FOREIGN PATENT DOCUMENTS

| | | | |
|---|---|---|---|
| 726157 | 11/1931 | France . | |
| 1133441 | 3/1957 | France . | |
| 2363299 | 3/1978 | France | 132/218 |
| 3708984 | 9/1988 | Germany | 401/129 |

*Primary Examiner*—Todd E. Manahan
*Assistant Examiner*—Eduardo C. Robert
*Attorney, Agent, or Firm*—Browdy and Neimark

[57] ABSTRACT

In a brush, in particular for coloring eyelashes or hair, comprising a stem and a number of bristles standing out essentially radially therefrom, the stem being formed by a first leg of a tweezers- or scissors-like arrangement, and a second leg of this arrangement having, at its free end, an abutment for the bristles of the first leg such that in operation, the free outer ends of the two legs enclose between them the eyelashes or hair to be treated. At least one of the two legs (4, 5) being designed as a hollow tube connected with a supply container and having outlets leading to the outside.

6 Claims, 1 Drawing Sheet

MASCARA BRUSH UNIT

BACKGROUND OF THE INVENTION

1. Technical Field of the Invention

The invention relates to a brush, in particular for the coloring of eyelashes or hair, comprising a stem and a plurality of bristles standing out substantially radially therefrom. The stem is formed by a first leg of a tweezers- or scissors-like arrangement. The second leg of this arrangement has, at its free end, an abutment for the bristles of the first leg such that in operation, the free outer ends of the two legs enclose between them the eyelashes or hair to be treated.

2. Prior Art

Brushes of the generic type, for instance in the form of mascara brushes, serve to apply mascara to the eyelashes. The application must be such that the lashes are colored uniformly and prevent application of too much liquid, which would cause clotting or lashes sticking together. In order to prevent the lashes from sticking together partially or entirely, mascara brushes of the generic type exhibit a combing effect in addition to good retention and dispensing capacity. To this end, attempts have been made to equip mascara brushes with different fibers or fibers of different rigidity, part of these fibers excelling in favorable mascara transport properties and the other part of the fibers by advantageous combing effects. However, the properties which seem to be attainable theoretically by such a design do not prevail in practice.

As for the dyeing or coloring of hair of the head, there is also the problem of uniform application, to which is added the fact that the dyeing or coloring agents are comparatively aggressive so that the application has to be accompanied by arrangements being made for the protection of the user's hands and surroundings.

OBJECT AND SUMMARY OF THE INVENTION

It is the object of the invention to embody a brush of the type mentioned at the outset in such a way that the application of the dyeing agent or mascara will be optimized, simultaneously providing for a uniformly attractive appearance of the colored eyelashes or the dyed hair.

According to the invention, this object is attained in that at least one of the two legs is a hollow tube connected with a supply container and provided with outlets that lead to the outside.

Consequently, it is possible to realize a very compact applicator or mascara unit, in which the bristles need not be dipped into the supply container for humidification, but in which the mascara is supplied from within the brush.

In keeping with an advantageous embodiment, it is further provided that a pumping operation is initiated by the two legs being moved relative to each other for liquid to be pumped from the supply container to the at least one brush. To this end, the outside wall of the supply container is at least partially elastic so that any actuation of the tweezers-like arrangement is accompanied by the pumping of liquid. It would also be conceivable to provide a separate pumping arrangement, a membrane or a piston of such a pumping arrangement being activated by the tweezers-like motion via an articulation.

Provision can be made for mascara, make-up removing liquid or hair dyeing agents to be kept in the supply reservoir so that the clamping effect may also serve to make use of increased pressure for the removal of mascara while make-up is removed.

In a very simple embodiment of the mascara brush or unit according to the invention, it can be provided that the two legs consist of wire of a certain intrinsic elasticity, preferably of a U-shaped wire, the legs being formed by the legs of the U.

Finally, provision can be made for the fibers to be fixed in place between intertwisted wire segments in a manner known per se and for the legs to be formed by intertwisted wires.

Favorably, it can be provided that the core of the brush formed by the intertwisted wire segments is again twisted on itself, in particular helically about a linear core available as a permanent component or as an auxiliary member only during manufacture. As a result, the volume is clearly increased and advantageous dispensing properties can be realized in case this embodiment is used as a mascara brush.

It is further possible to provide the core with outlets that communicate with the supply container so that for instance hair dyeing agents can be led directly onto the twisted brush arrangement.

Details of the invention will become apparent from the ensuing description of a preferred embodiment of the invention, taken in conjunction with the drawing. The drawing shows diagrammatic illustrations of various embodiments of brushes according to the invention in the form of mascara brushes or mascara units equipped with such brushes.

DETAILED DESCRIPTION OF THE PREFERRED EMBODIMENT(S) OF THE INVENTION

Figure 1:
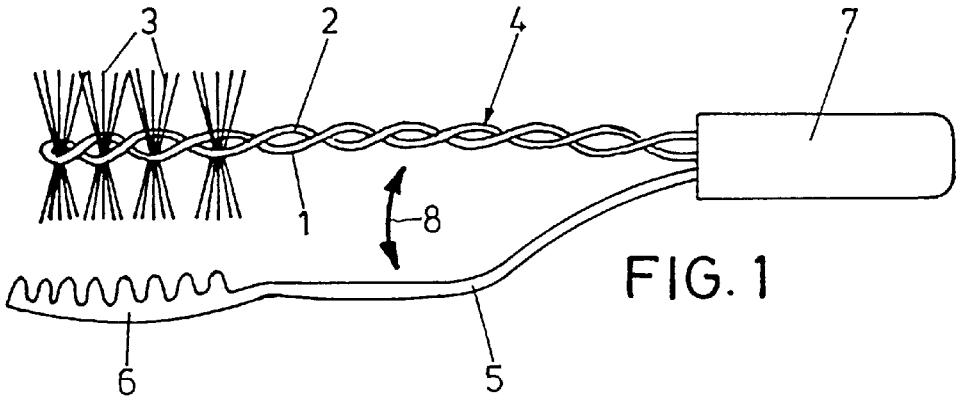
FIG. 1 shows a first embodiment of a mascara brush according to the invention.

In the embodiment of FIG. 1, the mascara brush bristles 3 are fixed in place in a manner known per se between two intertwisted wires 1, 2 or wire segments, forming a brush at the free left end of the brush.

No bristles 3 are provided at the rearward end of these wires 1, 2 thus forming a stem there that constitutes a first leg 4 of a tweezers-like arrangement. A second leg 5 is provided having a comb-type abutment element 6 at its free front end. Both legs 4, 5 are retained in a handle 7.

The legs 4, 5 exhibit a certain resilient intrinsic elasticity so that they can be moved toward or away from each other in the direction of the double-headed arrow 8 when held for example between the user's thumb and index finger.

Figure 2:
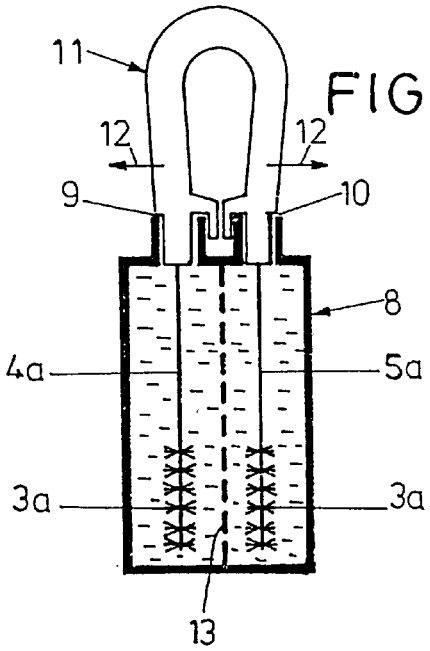
FIG. 2 shows a second embodiment of a mascara unit according to the invention.

FIG. 2 is a diagrammatic illustration of a mascara unit with a brush according to the invention being used. The upper side of the mascara container 8 has two openings 9, 10, into each of which reaches a leg 4*a*, 5*a*. Bristles 3*a* are disposed at the free outer ends of legs 4*a*, 5*a*. The two legs 4*a* and 5*a* are replaceably fixed to a handle 11 which serves simultaneously as a closure and is elastic, tending to spread—as outlined by the arrows 12—and being compressible between thumb and index fingers during use. A dividing wall 13 is shown by dashes in the drawing. The wall 13 divides the container 8 into two compartments for different liquids to be stored therein, which may for instance serve to trigger a reaction only during application when the two liquids contact, or to avoid segregration.

Figure 3:
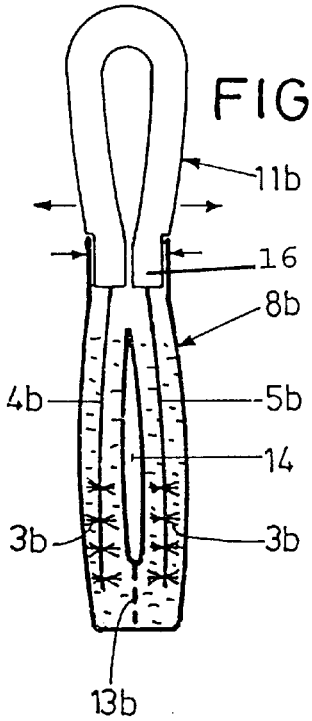
FIG. 3 shows a third embodiment of a mascara unit according to the invention.

FIG. 3 shows a variant of the solution according to FIG. 2, the container 8*b* being divided by an opening 14 in the central portion and split into two compartments, a leg 4*b*, 5*b* having bristles 3*b*, respectively, being disposed in each compartment. A dividing wall 13*b* may separate the two compartments in the lower portion. The handle 11*b* is elastically expansible and serves simultaneously as a closure for opening 16.

Figure 4:
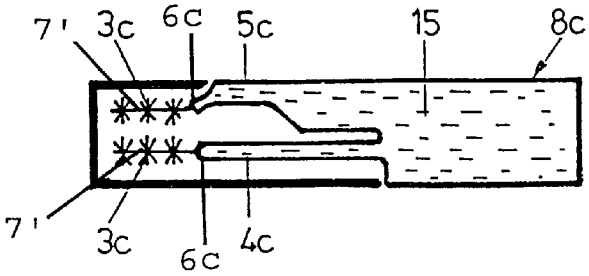
FIG. 4 shows a further embodiment of a mascara unit according to the invention.

In the embodiment of FIG. 4, the bristles 3*c* are disposed on the intertwisted wire stems 7 replaceably fastened on legs 4*c*, 5*c* which are hollow tubes connected with a mascara supply 15 in a container 8*c*, the mascara being transported for instance by pressure exercised on the at least partially flexible container wall. It is possible to supply only one or both groups of bristles 3*c* with mascara. As in the embodiments of FIGS. 1–3, at least leg 4*c* exhibits a certain resilient intrinsic elasticity so that it can be moved toward leg 5*c* when legs 4*c* and 5*c* are held between the user's thumb and index finger. If desirable, leg 5*a* can also have the same elasticity as leg 4*c*.

Consequently, it is possible to realize a very compact applicator or mascara unit, in which the bristles need not be dipped into the supply container for humidification, but in which the mascara is supplied from within the brush.

In keeping with this advantageous embodiment, it is further provided that a pumping operation is initiated by the two legs being moved relative to each other for liquid to be pumped from the supply container to the bristles. To this end, the outside wall of the supply container is at least partially elastic so that any actuation of the tweezers-like arrangement is accompanied by the pumping of the liquid.

Further, either one or both of the two hollow legs 4*c* and 5*c* have an outlet 6*c* to the outside and to bristles 3*c* wherein mascara make-up remover or hair dye from container 8*c* can be delivered to bristles 3*c* by placing pressure on the container 8*c*.

I claim:

1. A brush for coloring eyelashes or hair, comprising:

a pair of stems each having a plurality of bristles standing out substantially radially therefrom, each of said stems comprising two intertwisted wire segments of a U-shaped wire engaging said plurality of bristles, each of said stems being respectively removably fastened to a pair of legs of a unitary body, at least one leg of said pair of legs is intrinsically elastic and flexible relative to another leg of said pair of legs of the unitary body so as to form a tweezer arrangement wherein the bristles on each of said pair of stems can enclose between them the eyelashes or hair to be treated, wherein at least one of the pair of legs is a hollow tube connected with a supply container in said unitary body, said supply container being a handle of the brush, said hollow tube having an outlet, wherein moving said at least one leg relative to said another leg of said unitary body, pumps a liquid content from said supply container through said outlet to said bristles on the stem of the hollow tube.

2. The brush according to the claim 1, wherein said supply container has a liquid content which is mascara.

3. The brush according to claim 1, wherein said supply container has a liquid content which is a make-up removing liquid.

4. The brush according to claim 1, wherein said supply container has a liquid content which is a hair dying agent.

5. The brush according to claim 1, wherein each of said pair of legs is hollow and has an outlet communicating with the supply container to permit the liquid content of said supply container to be pumped to the bristles on each of said pair of stems.

6. The brush according to claim 1, wherein each of said pair of legs is intrinsically elastic and flexible relative to each other.

* * * * *